US008358944B2

(12) United States Patent
Yamade

(10) Patent No.: US 8,358,944 B2
(45) Date of Patent: Jan. 22, 2013

(54) IMAGE FORMING APPARATUS AND METHOD FOR PRINT CONTROL

(75) Inventor: Yasushi Yamade, Yokohama (JP)

(73) Assignee: Konica Minolta Business Technologies, Inc. (JP)

( * ) Notice: Subject to any disclaimer, the term of this patent is extended or adjusted under 35 U.S.C. 154(b) by 370 days.

(21) Appl. No.: 12/716,560

(22) Filed: Mar. 3, 2010

(65) Prior Publication Data

US 2010/0226665 A1 Sep. 9, 2010

(30) Foreign Application Priority Data

Mar. 6, 2009 (JP) ..... 2009-052944

(51) Int. Cl.
*G03G 15/01* (2006.01)
*G03G 21/18* (2006.01)

(52) U.S. Cl. ..... 399/39; 399/54; 399/112; 399/223

(58) Field of Classification Search ..... 399/39, 399/54, 112, 223, 252, 298, 299, 300
See application file for complete search history.

(56) References Cited

U.S. PATENT DOCUMENTS

| | | | | |
|---|---|---|---|---|
| 6,819,902 | B2 * | 11/2004 | Toyohara et al. | 399/298 |
| 6,996,358 | B2 * | 2/2006 | Ayaki et al. | 430/45.4 |
| 7,130,550 | B2 * | 10/2006 | Mochizuki | 399/54 X |
| 7,343,125 | B2 * | 3/2008 | Miyake | 399/299 |
| 7,450,894 | B2 * | 11/2008 | Matsumoto | 399/302 |
| 8,007,969 | B2 * | 8/2011 | Lieberman | 399/223 X |
| 2008/0310873 | A1 * | 12/2008 | Ono | 399/39 X |

FOREIGN PATENT DOCUMENTS

| | | | |
|---|---|---|---|
| JP | 8-244254 | a | 9/1996 |
| JP | 10-44473 | a | 2/1998 |
| JP | 2002-072572 | * | 3/2002 |
| JP | 2004-27535 | A | 1/2004 |

* cited by examiner

*Primary Examiner* — Sandra Brase
(74) *Attorney, Agent, or Firm* — Cantor Colburn LLP

(57) ABSTRACT

Provided are an image forming apparatus and a method for print control which can carry out printing using appropriate toners without selecting an apparatus to be used from apparatuses loaded with different toner groups depending on a print object. In an image forming apparatus provided with an image forming section including photoreceptor drums, writing units to form electrostatic latent images on the photoreceptor drums, and development devices to carry out development by feeding toners to the latent image, there are loaded, as the toners, a first toner group (for example, normal toners) containing three colors of CMY; a second toner group (for example, Vivid toners) containing three colors of CMY with a wider color reproduction area than the first toner group; and a K (black) toner.

14 Claims, 14 Drawing Sheets

IMAGE FORMING APPARATUS AND METHOD FOR PRINT CONTROL

This application is based on Japanese Patent Application No. 2009-052944 filed on Mar. 6, 2009, in Japanese Patent Office, the entire content of which is hereby incorporated by reference.

TECHNICAL FIELD

The present invention relates to an image forming apparatus and a method for print control, and specifically to an image forming apparatus provided with plural types of toner groups having different color reproduction areas and a method for print control employing the image forming apparatus.

BACKGROUND

Printing apparatuses (hereinafter referred to as image forming apparatuses) such as printers or digital multifunction peripherals have become widespread. In such an image forming apparatus, an image is formed based on a print job transmitted from a computer terminal, and then a charged photoreceptor is irradiated with light based on the image to form an electrostatic latent image, which is developed with charged toner being attached. The resulting toner image is transferred to a sheet of paper via an intermediate transfer body such as a transfer roller or a transfer belt.

Members such as toners used for an image forming apparatus each have color characteristics. Some colors are easy to reproduce and other colors are difficult to reproduce with them. Therefore, in view of the color characteristics of these members, various types of methods for image forming have been proposed to reproduce the original image color as precisely as possible.

For example, Unexamined Japanese Patent Application Publication No. 2002-182634 discloses an apparatus in which characteristics of a target image are automatically identified and then switching is carried out to an optimum color reproduction processing (color matching) method based on these detected image characteristics. Further, Unexamined Japanese Patent Application Publication Nos. H08-244254 and H10-44473 disclose apparatuses using seven color inks of cyan, magenta, yellow, black (K), red, green, and blue.

In such manners, reproduction methods are switched based on image characteristics, or a color formed via superimposition of plural inks is replaced by a single-color ink, whereby a color close to the original image can be reproduced. However, a toner group containing toners of CMY, CMYK, or CMYK+RGB has a reproducible color area (referred to as a color reproduction area). Therefore, when any color falling outside the color reproduction area is contained in the original image, an image exhibiting a desired color is unable to be reproduced.

SUMMARY

In view of such a background, over recent years, there has been developed a toner group (hereinafter referred to as "Vivid toner") which can reproduce a more saturated and brilliant color than a toner group (hereinafter referred to as "normal toner") having been conventionally used. Using an image forming apparatus loaded with this Vivid toner, a color outside the color reproduction area of a normal toner is reproduced faithfully.

However, a Vivid toner is more expensive than a normal toner. Therefore, in cases in which the original image contains only colors reproducible with either of both toners (that is, colors falling within the color reproduction areas of the both toners), printing is with a Vivid toner causes an increase in printing cost. Further, when a Vivid toner is used for printing, the resulting color is brilliant. Therefore, when a deep color with low color saturation is reproduced, use of a normal toner may realize more faithful reproduction.

Accordingly, in order to minimize printing cost and to enhance color reproducibility, it is desirable to select an appropriate toner group depending on the original image color. However, conventionally, there have been unavailable image forming apparatuses loaded with plural types of toner groups having different color reproduction areas such as a normal toner and a Vivid toner. And also there have been no methods in which an appropriate toner group is selected depending on color of an original color and the color reproduction area of each toner group. Therefore, the above problems have been unable to be solved.

In view of forgoing, one embodiment according to one aspect of the present invention is an image forming apparatus, comprising:

an image forming section, the image forming section including:

a photoreceptor drum;

a writing unit for forming an electrostatic latent image on the photoreceptor drum; and a development device for supplying toner to the photoreceptor drum to develop the electrostatic latent image into a toner image, wherein the image forming apparatus is loaded, as the toner, with the following toner:

first cyan toner, first magenta toner, and first yellow toner which constitute a first toner group;

second cyan toner, second magenta toner, and second yellow toner which constitute a second toner group which has a wider color reproduction area than the first toner group; and black (K) toner.

According to another aspect of the present invention, another embodiment is a method for control of printing in a system including an image forming apparatus which includes an image forming section having: a photoreceptor drum; a writing unit for forming an electrostatic image of the photoreceptor drum; and a development device for supplying toner to the photoreceptor drum to develop the electrostatic latent image into a toner image, wherein the image forming apparatus is loaded, as the toner, with a first toner group containing a first cyan toner, a first magenta toner, and a first yellow toner, and with a second toner group containing a second cyan toner, a second magenta toner, and a second yellow toner, wherein the second toner group has a wider color reproduction area than the first toner group, the method comprising the step of:

(1) storing the color reproduction area of the first toner group and the color reproduction area of the second toner group;

(2) converting color information of image portions constituting a print object image into values in a predetermined color space;

(3) determining which toner group to use to print the print object image, depending on a result of comparing the converted values with the stored two color reproduction areas; and (4) printing the print object image by using the determined toner group.

According to another aspect of the present invention, another embodiment is an image forming apparatus, comprising:

an image forming section for forming a color image by superposing a cyan toner image, a magenta toner image, a yellow toner image, and a black (K) toner image, the image forming section including:

a first development device group configured of three development devices each of which supplies each of a first cyan toner, a first magenta toner, and a first yellow toner to develop an electrostatic latent image into a toner image;

a second development device group configured of three development devices each of which supplies each of a second cyan toner, a second magenta toner, and a second yellow toner to develop an electrostatic latent image into a toner image, the second toners having a wider color reproduction area than the first toners; and a black (K) development device for supplying black (K) toner to develop an electrostatic latent image into a toner image.

DETAILED DESCRIPTION OF THE PREFERRED EMBODIMENT

Figure 1:
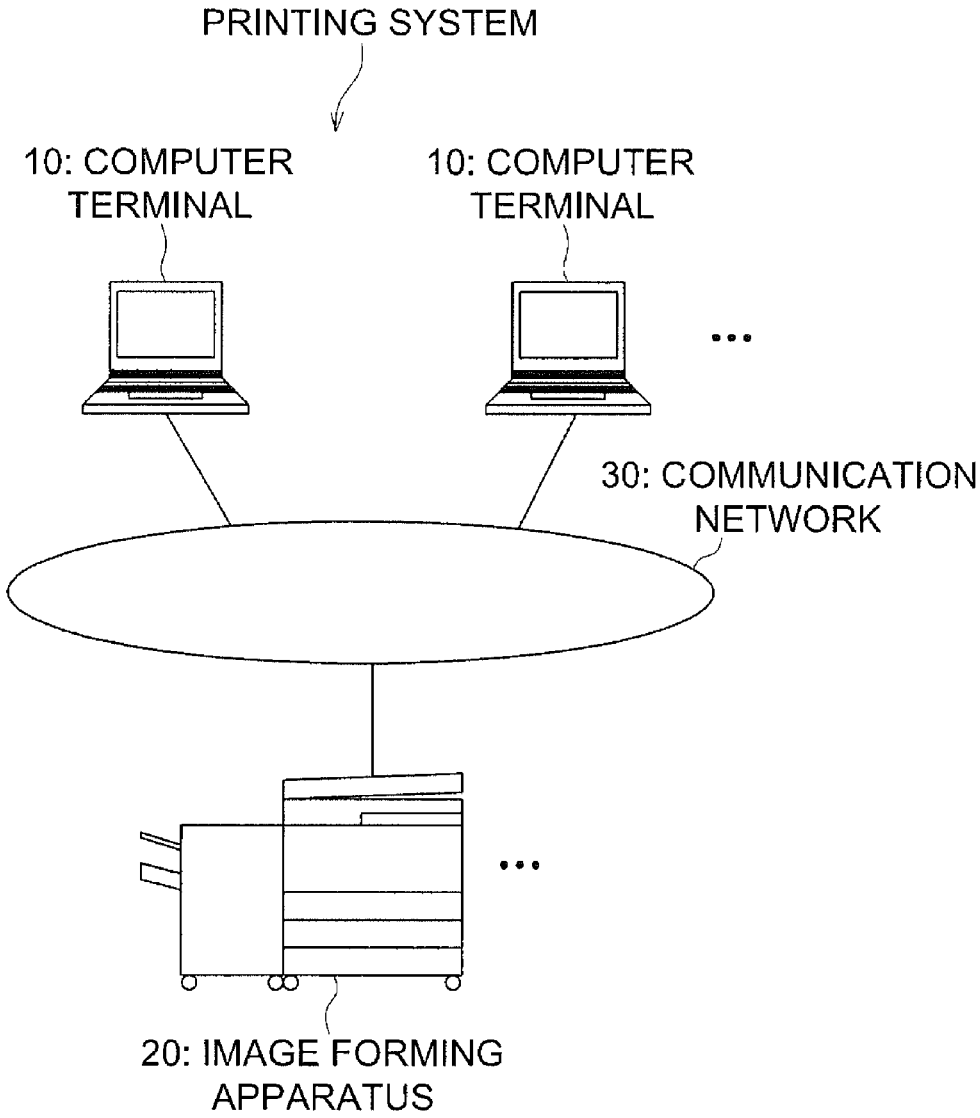
FIG. 1 is a diagram showing a configuration example of a printing system according to an embodiment of the present invention.

As described in the background technology, an image forming apparatus loaded with a Vivid toner can reproduce a more saturated and brilliant color than an image forming apparatus loaded with a normal toner. However, such a Vivid toner is more expensive than a normal toner. Therefore, a color to be reproducible with either of both toners is desirably printed using a normal toner. Further, for a deep color with low color saturation, a normal toner may produce more faithful reproduction.

Therefore, in one embodiment of the present invention, an image forming apparatus is loaded with plural types of toner groups such as a first toner group (for example, normal toners) and a second toner group (for example, Vivid toners) having higher color saturation (a wider color reproduction area) than the first toner group. In this manner, since a single image forming apparatus is loaded with plural types of toner groups, it is not necessary to select an appropriate image forming apparatus corresponding to a print object, thereby enhancing user convenience.

Further, in another embodiment of the present invention, when printing is carried out only using one toner group, the operation of the image forming section of the other toner group is suspended, or the image forming sections (the writing units and photoreceptor units) of normal toners (CMY) and Vivid toners (CMY) are made into respective single image forming units, and then the operation of the image forming unit of unused toner group is suspended or withdrawn from the transfer belt. Thereby, consumption of the unused toner group is minimized, whereby the product life cycle can be extended, and also the attaching of the toner remaining on the photoreceptor drum of such an unused toner group to the transfer belt is controlled, thereby resulting in minimizing deterioration of print image quality.

Still further, in another embodiment of the present invention, one photoreceptor drum is provided with development section and writing units of a normal toner and a development section and writing units for respective Vivid CMY toners and respective normal CMY toners. In this manner, unitization for each color reduces the number of photoreceptor drums, resulting in realization of size reduction of an image forming apparatus.

Yet further, in an image forming apparatus having the above constitution, an image to be printed is converted into a value in a certain color space (for example, a Lab value) in predetermined units (for example, Bit units), and judgment is made about what area the value belongs to in the color reproduction area of each toner group. According to the judgment result, an appropriate toner group is determined to be used. For example, for a color able to be reproduced only with a first toner group, the first toner group is used. For a color able to be reproduced only with a second toner group, the second toner group is used. For a color able to be reproduced with either of both toner groups, controlling is carried out to use one predetermined toner group (a more inexpensive toner group). Further, with regard to a color unable to be reproduced with any of the both toner groups, controlling is conducted to use a toner group exhibiting higher reproducibility (a closer color reproduction area). Thereby, an output result closer to the desired image can be obtained and also the cost can be controlled at a requisite minimum.

Figure 2:
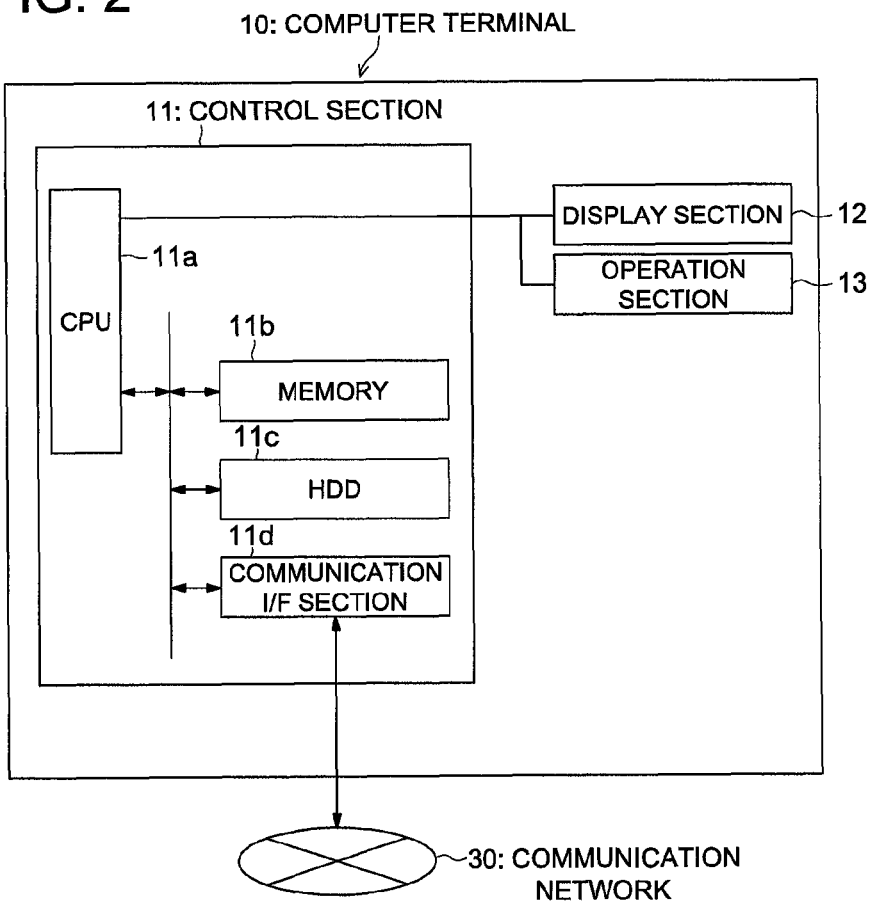
FIG. 2 is a block diagram showing a configuration of a computer terminal according to an embodiment of the present invention.
Figure 3:
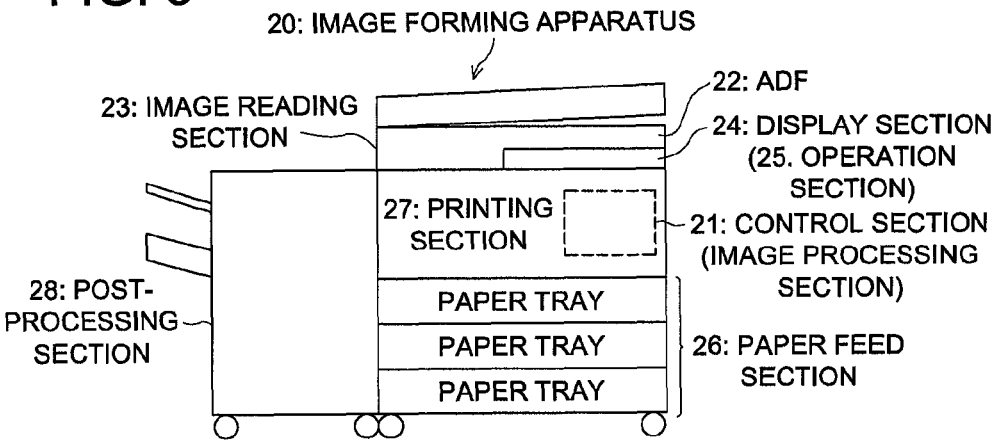
FIG. 3 is a schematic view showing a configuration of an image forming apparatus according to an embodiment of the present invention.
Figure 4:
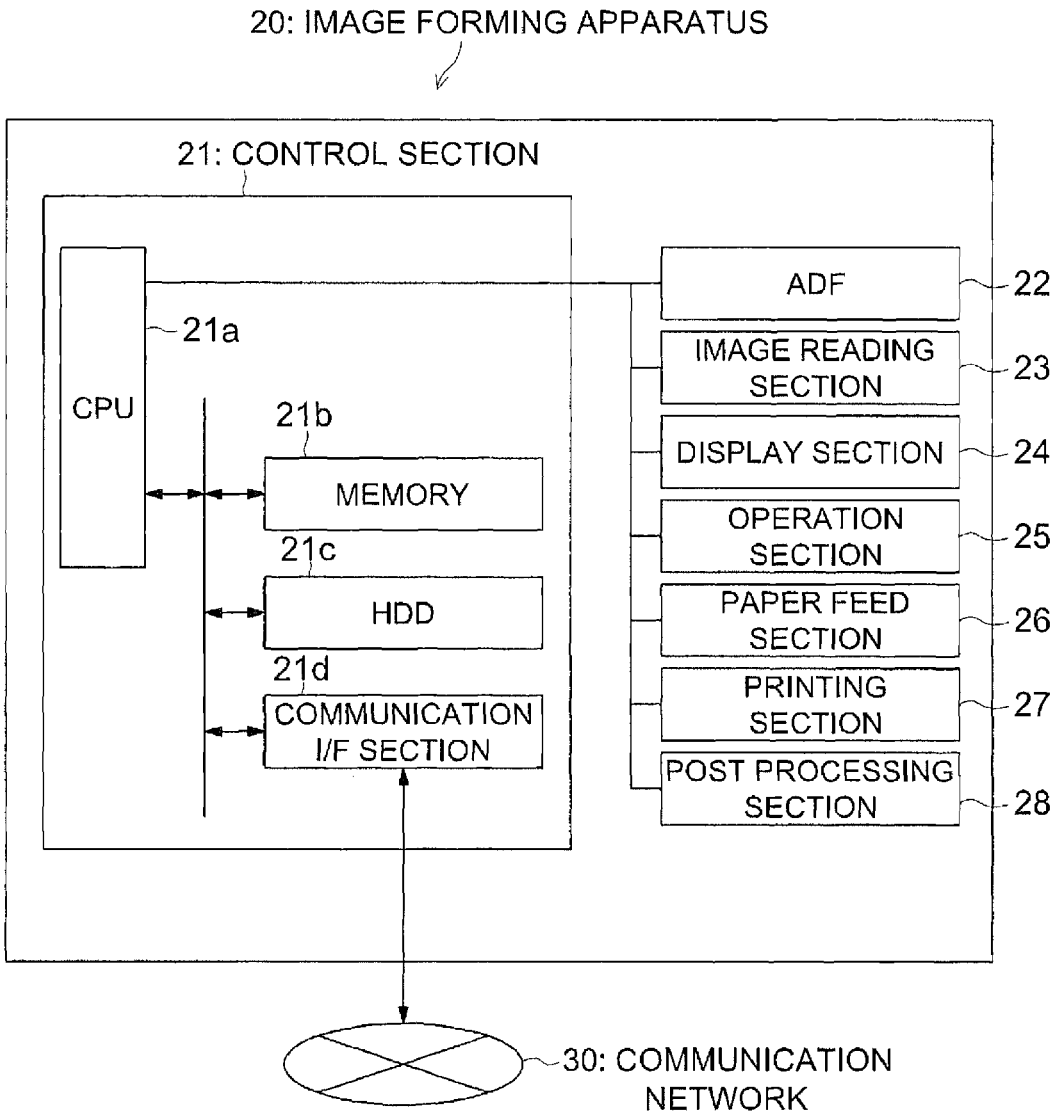
FIG. 4 is a block diagram showing a configuration of an image forming apparatus according to an embodiment of the present invention.
Figure 8:
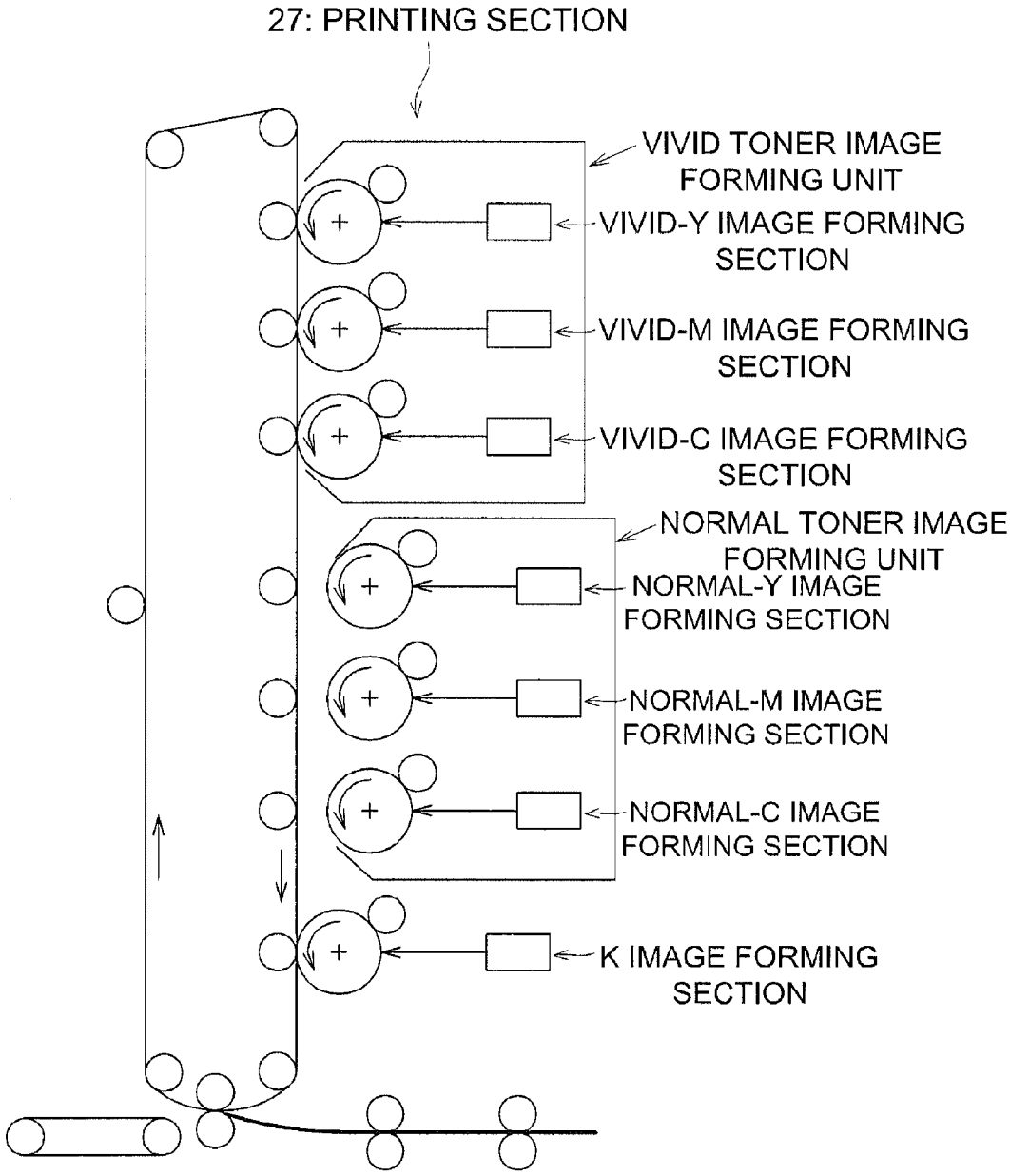
FIG. 8 is a view showing a state in which a normal toner image forming unit of a printing section of an image forming apparatus according to an embodiment of the present invention is withdrawn.
Figure 9:
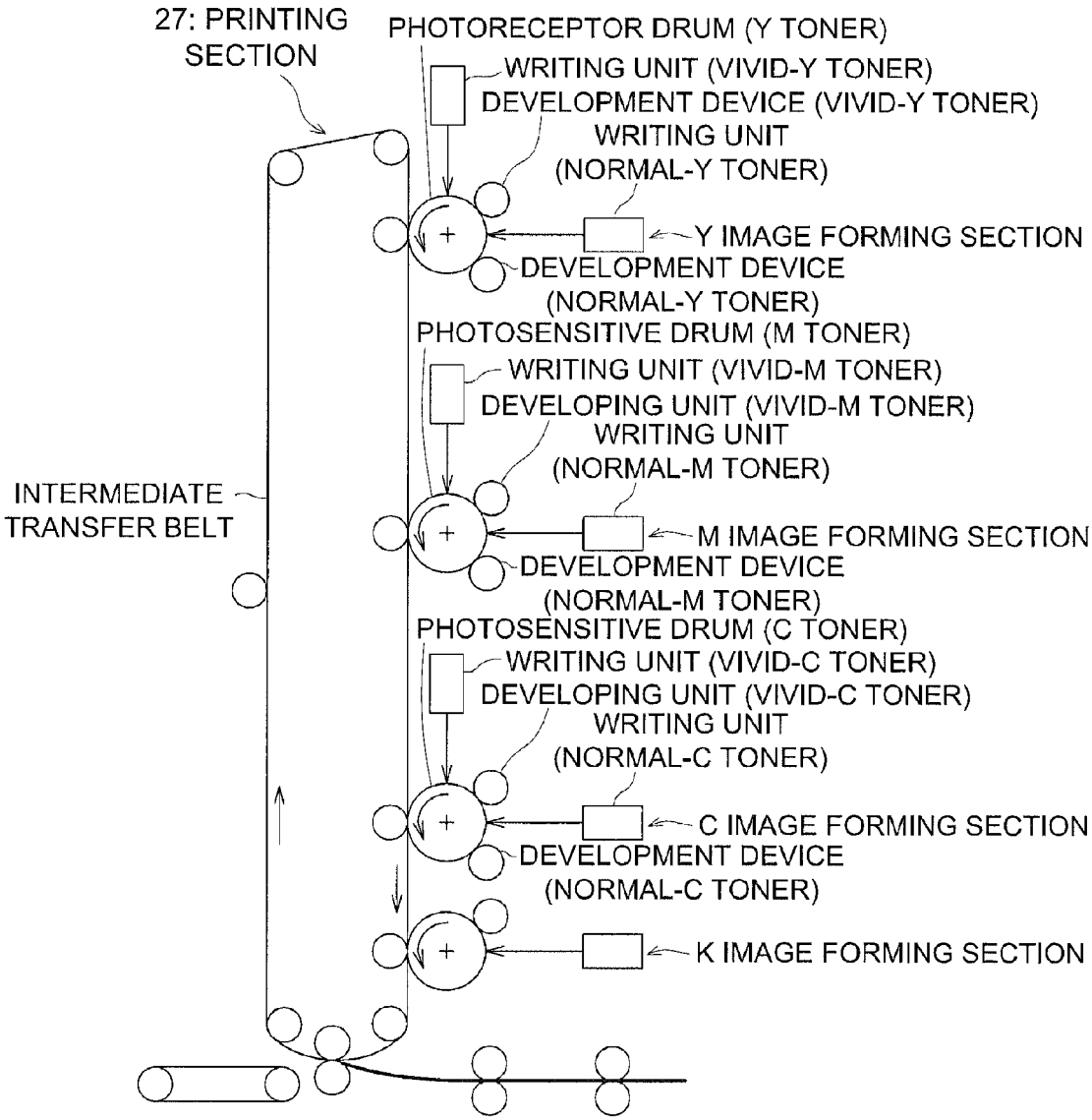
FIG. 9 is a view showing a configuration in which printing sections of an image forming apparatus according to an embodiment of the present invention are each made for each color.
Figure 10:
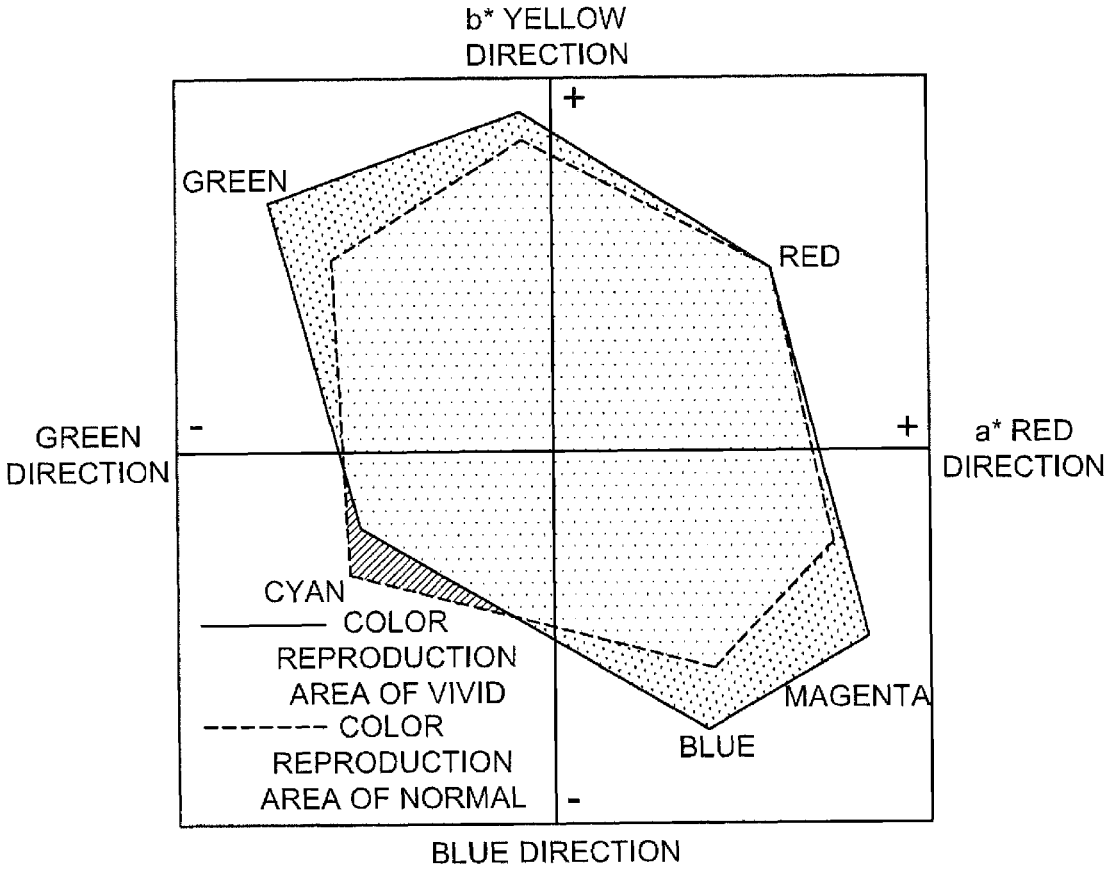
FIG. 10 is a diagram showing the color reproduction areas of Vivid toners and normal toners.
Figure 11:
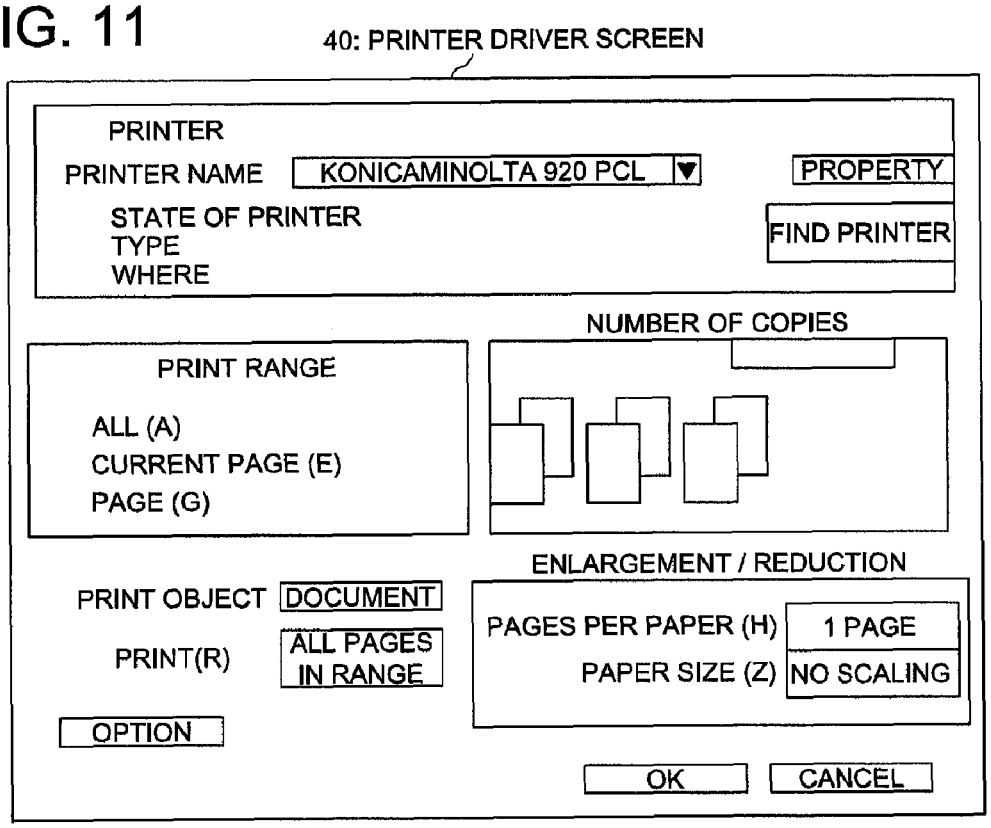
FIG. 11 is a view showing an example of a screen (printer driver screen) displayed on the display section of a computer terminal according to an embodiment of the present invention.
Figure 12:
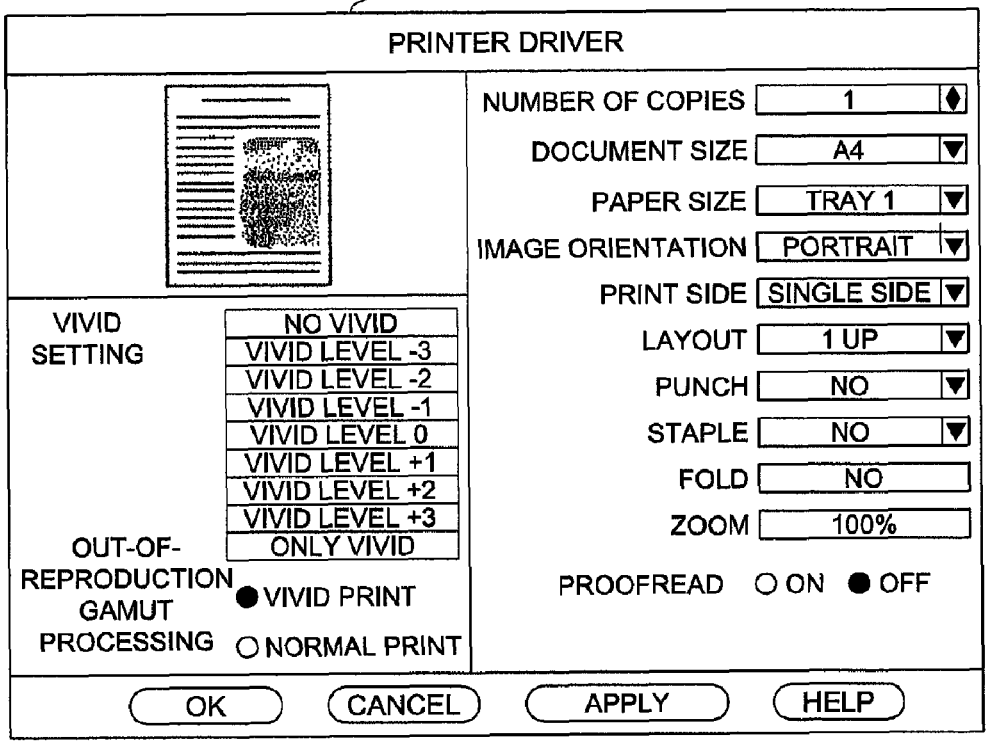
FIG. 12 is a view showing an example of a screen (property screen) displayed on a display section of a computer terminal according to an embodiment of the present invention.
Figure 13:
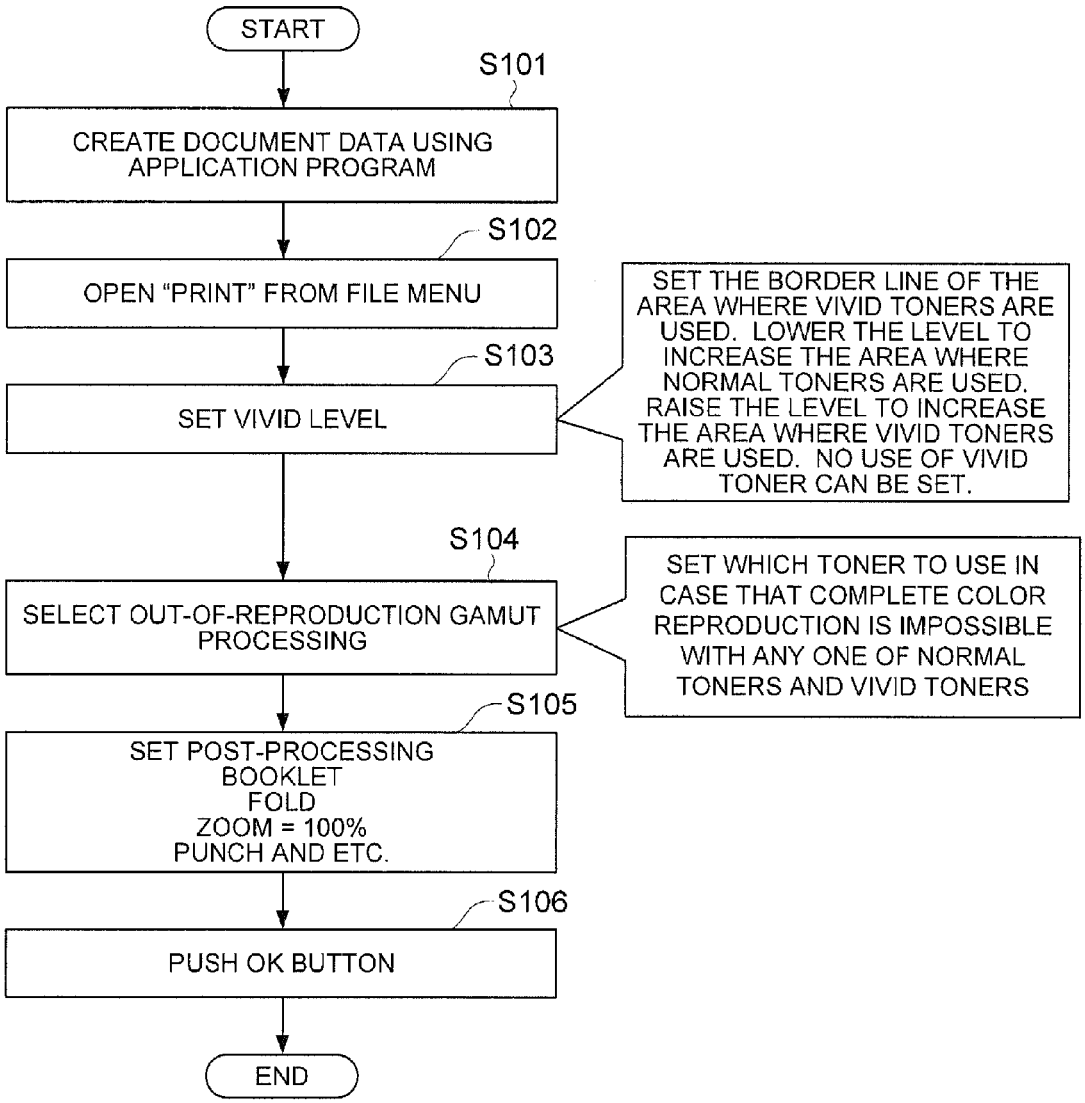
FIG. 13 is a flowchart showing user operation procedures in a computer terminal according to an embodiment of the present invention.
Figure 14:
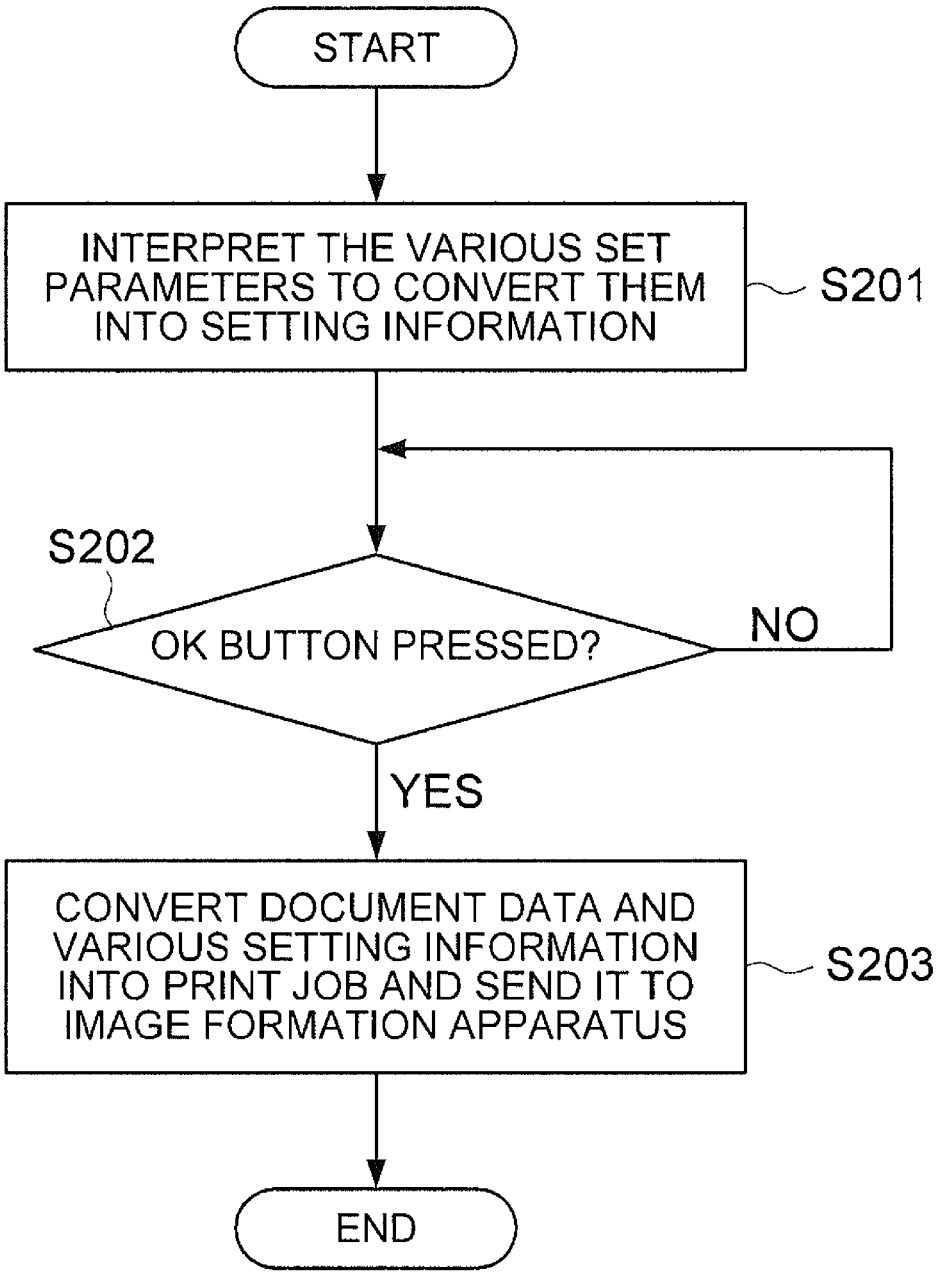
FIG. 14 is a flowchart showing an operation of a printer driver in a computer terminal according to an embodiment of the present invention.
Figure 15:
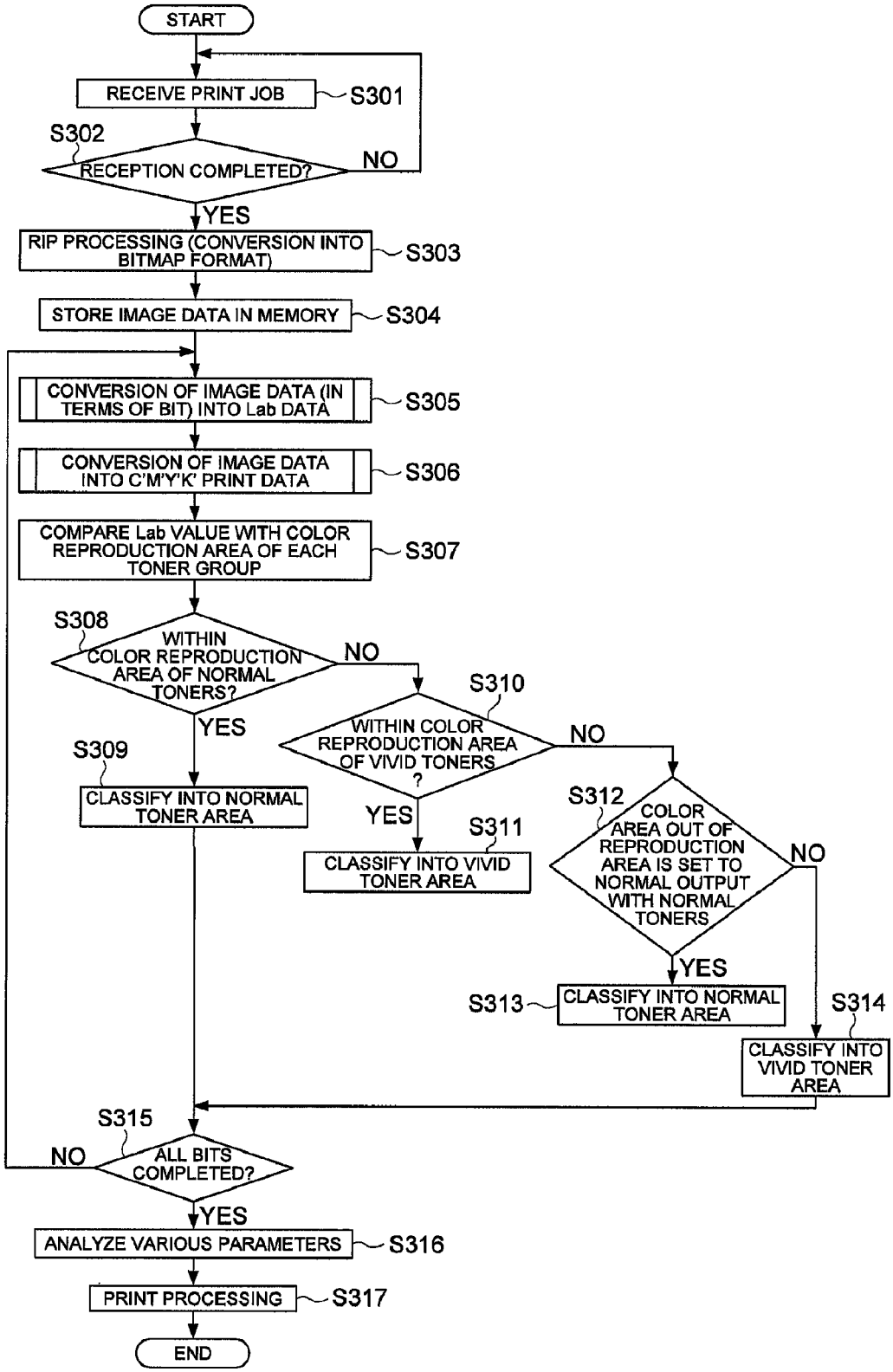
FIG. 15 is a flowchart showing an entire operation of an image forming apparatus according to an embodiment of the present invention.
Figure 16:
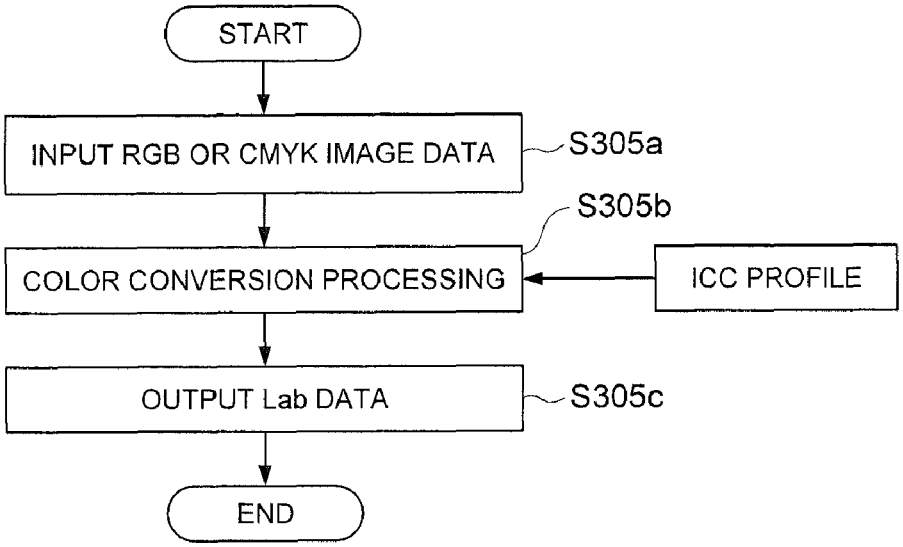
FIG. 16 is a flowchart showing procedures of conversion to Lab data in an image forming apparatus according to an embodiment of the present invention.
Figure 17:
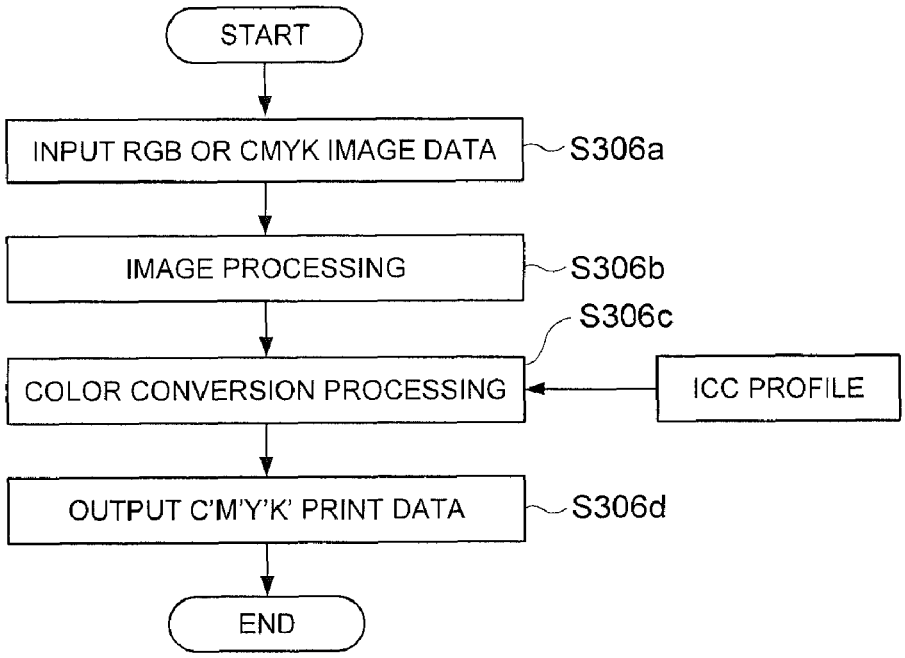
FIG. 17 is a flowchart showing procedures of conversion to CMYK print data in an image forming apparatus according to an embodiment of the present invention.

To describe the above embodiments of the present invention in more detail, an image forming apparatus and a method for print control according to one embodiment of the present invention will now be described with reference to FIG. 1-FIG. 17. FIG. 1 is a diagram showing a configuration of a printing system of the present embodiment, and FIG. 2 is a diagram showing a configuration of a computer terminal. FIG. 3 and FIG. 4 are views each showing a configuration of an image forming apparatus, and FIG. 5-FIG. 9 are views each showing a configuration example of the printing section of the image forming apparatus. FIG. 10 is a diagram showing the color reproduction areas of normal toner and Vivid toners, and FIG. 11 and FIG. 12 are views each showing one example of a screen displayed on the display section of the computer terminal. FIG. 13 and FIG. 14 are flowcharts each showing operations in the computer terminal, and FIG. 15-FIG. 17 are flowcharts each showing operations in the image forming apparatus.

As shown in FIG. 1, the printing system of the present embodiment includes one or plural computer terminals 10 to transmit and receive print jobs; and one or plural image forming apparatuses 20 to receive print jobs and to carry out printing. These are connected together via a communication network 30 such as LAN (Local Area Network) or WAN (Wide Area Network) defined by a standard such as Ethernet (a registered trademark), Token Ring, or FDDI (Fiber-Distributed Data Interface).

Further, as shown in FIG. 2, computer terminal 10 includes control section 11, display section 12, and operation section 13.

Control section 11 is provided with a CPU (Central Processing Unit) 11*a*, a memory 11*b* such as a ROM (Read Only Memory) or a RAM (Random Access Memory), an HDD (Hard Disk Drive) 11*c*, and a communication I/F section 11*d*, which are connected together via a bus. CPU 11*a* controls each section. Memory 11*b* is a section to temporarily memorize various data read from HDD 11*c* or communication I/F section 11*d*. The memorized data is processed by CPU 11*a* and transferred, if required, to HDD 11*c* or communication I/F section 11*d*. HDD 11*c* stores a program for CPU 11*a* to control each section, information on the processing function of its own device, and a print job, which are read by CPU 11*a*, if necessary, to be executed on memory 11*b*. Communication I/F section 11*d* establishes connection to devices linked via communication network 30 to execute data transmission and reception.

Control section 11 described above functions as a printer driver for executing application programs to prepare documents and for issuing instructions of printing documents. Then, document data prepared by the application is converted by the printer driver into a print job of a language able to be read by image forming apparatus 20 (PCL (Printer Control Language)) or PDL (Page Description Language) such as PS (Post Script), and transmitted to image forming apparatus 20 via communication I/F section 11*d*.

Display section 12 contains a liquid crystal display device (LCD: Liquid Crystal Display) or an organic EL (electroluminescence) display device, and displays a printer driver screen or a property screen to configure a print job to be transmitted to image forming apparatus 20.

Operation section 13 is a section to manipulate information displayed on display section 12 and to input information, including devices such as a pointing device, a keyboard, a trackball, a trackpad, a tablet, and a stylus pen.

Further, as shown in FIG. 3 and FIG. 4, image forming apparatus 20 includes a control section 21, an ADF (Auto Document Feeder) 22, an image reading section 23, a display section 24, an operation section 25, a paper feed section 26 a printing section 27, and a post-processing section 28.

Control section 21 is a section to control each component, being provided with a CPU 21*a*, memory 21*b* such as a ROM or a RAM, an HDD 21*c*, and a communication I/F section 21*d*, which are connected together via a bus. CPU 21*a* controls each section. Memory 21*b* is a section to temporarily memorize various data read from HDD 21*c*, image reading section 23, or communication I/F section 21*d*. The memorized data is image-processed by CPU 21*a* and transferred, if required, to HDD 21*c* or printing section 27. HDD 21*c* stores a program for CPU 21*a* to control each section, information on the processing function of its own device, data to define the color reproduction area of each toner group in a predetermined color space, and an ICC (International Color Consortium) profile, which are read by CPU 21*a*, if necessary, to be executed on memory 21*b*. Communication I/F section 21*d* establishes connection to devices linked via communication network 30 to execute data transmission and reception.

Control section 21 described above also functions as an image processing section to prepare bitmap data able to be printed by printing section 27 by rasterizing data of each page of a print job, performing image processing, and screening if necessary.

Further, control section 21 controls the operation of each section of printing section 27 and also converts bitmap data of each page into a value in a certain color space in predetermined units (for example, Bit units). Then, judgment is made about what area the value belongs to in the color reproduction areas of a first toner group (for example, normal toners) and a second toner group (toner having higher color saturation than normal toners, e.g., Vivid toners) (namely, whether or not the color can be reproduced only with one toner group; whether or not the color can be reproduced with either of both toner groups; or whether or not the color cannot be reproduced with any one of the both toner groups). According to the judgment result, the control section also functions as a print control section to determine a toner group to be used (for example: if the color can be reproduced only with one toner group, the toner group is used; if the color can be reproduced with either of both toner groups, the less expensive toner group is used; if the color cannot be reproduced with any of the both toner groups, a toner group exhibiting more excellent color reproducibility is used). This print control section may be configured as hardware, or may be configured as a print control program to cause the computer to function as a print control section for realization of a configuration to execute the program on control section 21.

ADF 22 is a section to automatically convey a single sheet or plural sheets of original documents to image reading section 23.

Image reading section 23 is a section to optically read image data from an original document on the platen, and includes a light source to scan the original, an image sensor such as a CCD (Charged Coupled Device) to convert light reflected by the original into an electrical signal, and an A/D converter for A/D conversion of the electrical signal.

Display section 24 includes a liquid crystal display device or an organic EL display device and displays various kinds of screens to operate image forming apparatus 20. Further, operation section 25 includes buttons and switches and carries out various kinds of settings and instructions. Herein, display section 24 and operation section 25 may be separately configured as individual devices, or an integrated device may be configured in such a manner that pressure-sensitive-type operation section (touch panel) 25 having transparent electrodes arranged in a grid pattern is provided on display section 24. In the case of such a touch panel, the XY coordinate of a stress point pressed with a finger or a touch pen is detected in voltage values and the thus-detected location signal is output as an operation signal to control section 21.

Paper feed section 26 includes paper trays to store various sizes of paper, and further includes a section to send such stored paper to printing section 27.

Printing section 27 includes components required for image formation employing an image forming process such as an electrophotographic system or an electrostatic recording system, and forms an image on a sheet of designated paper on the basis of image data read from image reading section 23 or a print job received via communication I/F section 21*d*, followed by sending the sheet to post-processing section 28. Printing section 27 will be detailed later.

Post-processing section 28 outputs sheets of paper conveyed from printing section 27 after finishing processing desired by the user such as punching, stapling, or binding in response to instructions from control section 21.

FIG. 1-FIG. 4 each represent one example of the present embodiments, being able to be appropriately modified. For example, when image forming apparatus 20 is used as a printer, ADF 22 or image reading section 23 may be omitted. When no post-processing needs to be carried out, post-processing section 28 may be omitted.

Further, in FIG. 1, the printing system is configured of computer terminals 10 and image forming apparatus 20. However, the printing system may be configured in such a manner that a control device such as a RIP (Raster Image Processor) controller converting a print job into bitmap data is connected to communication network 30. In this case, such a control device is only needed to function as a print control section (print control program).

Hereinafter, a specific configuration of printing section 27 will be described.

Figure 5:
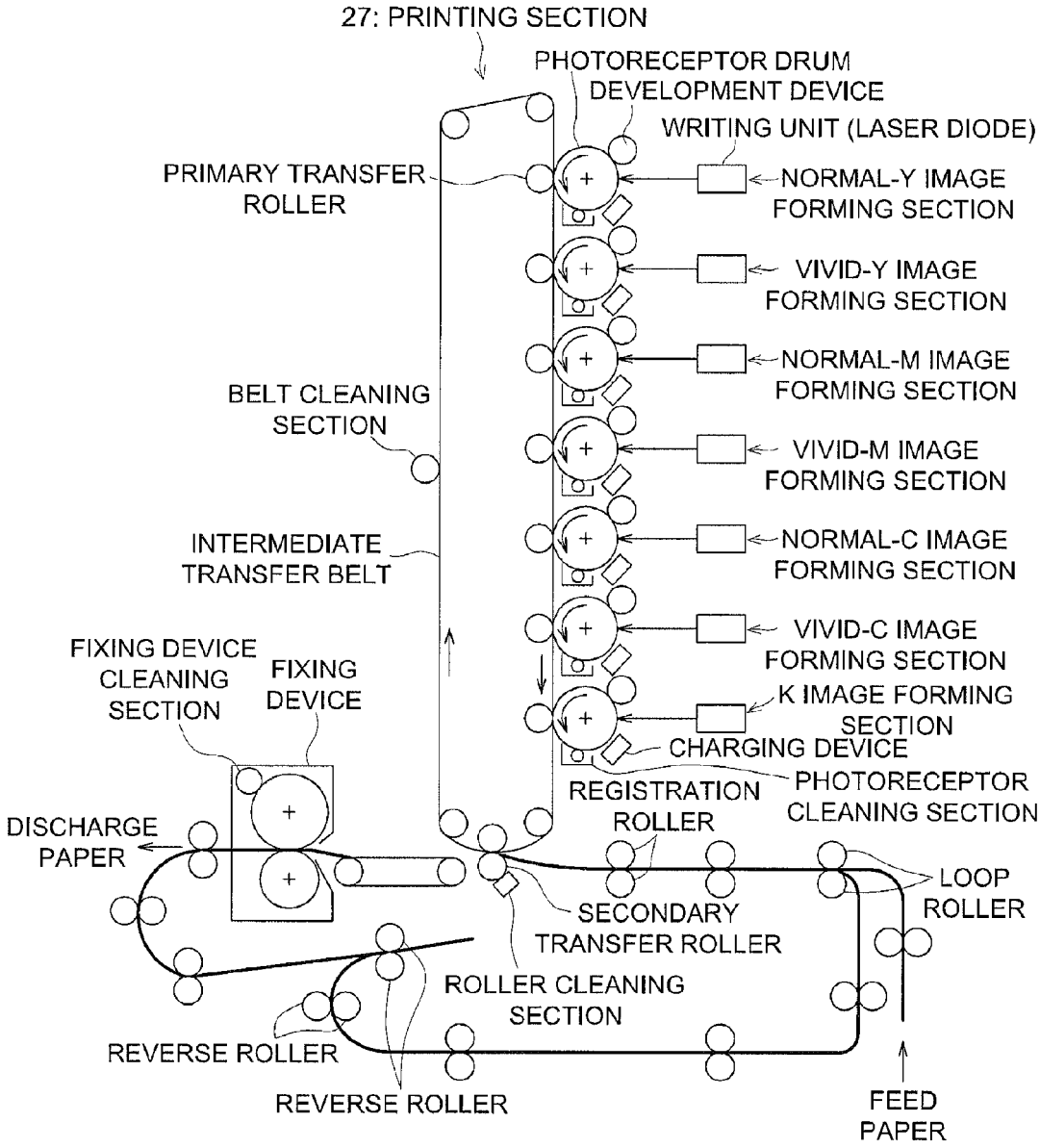
FIG. 5 is a view showing a specific configuration of a printing section of an image forming apparatus according to an embodiment of the present invention.

As shown in FIG. 5, printing section 27 includes writing units, photoreceptor units, a transfer unit, and a conveyance unit. The writing unit includes a laser diode, and emits laser light for exposure depending on bitmap data input from an image processing section. The photoreceptor unit includes a photoreceptor drum, a development device, a charging device, and a photoreceptor cleaning section, and forms a latent image of a toner fed from the development device on the photoreceptor drum. In the present embodiment, provided are seven photoreceptor units and writing units corresponding to toners of seven colors in total: yellow (Y), magenta (M), cyan (C) included in a first toner group (a normal toner); yellow (Y), magenta (M), cyan (C) included in a second toner group (a Vivid toner) exhibiting higher color saturation (a wider color reproduction area) than the first toner group; and black (K). These units are independently controlled for driving/stopping by the print control section (print control program). The transfer unit includes a primary transfer roller, an intermediate transfer belt, a belt cleaning section, a secondary transfer roller, and a roller cleaning section, and transfers a toner image formed in the photoreceptor unit to the intermediate transfer belt functioning as an intermediate transfer body, followed by transferring the toner image formed on the intermediate transfer belt to a sheet of paper. A fixing unit includes a fixing device and a fixing device cleaning section, and fixes the toner image transferred onto the sheet of paper. The conveyance unit includes a paper feed roller, a registration roller, a loop roller, a reverse roller, and a paper discharge roller, and conveys a sheet of desired paper from paper feed section 27 to the secondary transfer roller, and then discharges the sheet of paper having been fixed to post-processing section 28.

FIG. 5 represents a fundamental configuration of printing section 27. Herein, the following problems tend to be produced by such a configuration that the seven photoreceptor units, which are for three colors of CMY as a normal color, three colors of CMY as a Vivid color, and K, are always in contact with the intermediate transfer belt. For example, in cases in which image formation is carried out only using four colors in total including three colors of normal CMY toners and K, when photoreceptor units for an unused Vivid toners are driven, there is produced such a problem that the product life cycle of the Vivid toner is shortened or the Vivid toner remaining on the photoreceptor drums attaches to the intermediate transfer belt. In contrast, in cases in which image formation is carried out only using four colors in total including three colors of Vivid CMY toners and K, when photoreceptor units for an unused normal toner are driven, there is produced such a problem that the product life cycle of the normal toner is shortened or the normal toner remaining on the photoreceptor drums attaches to the intermediate transfer belt.

Figure 6:
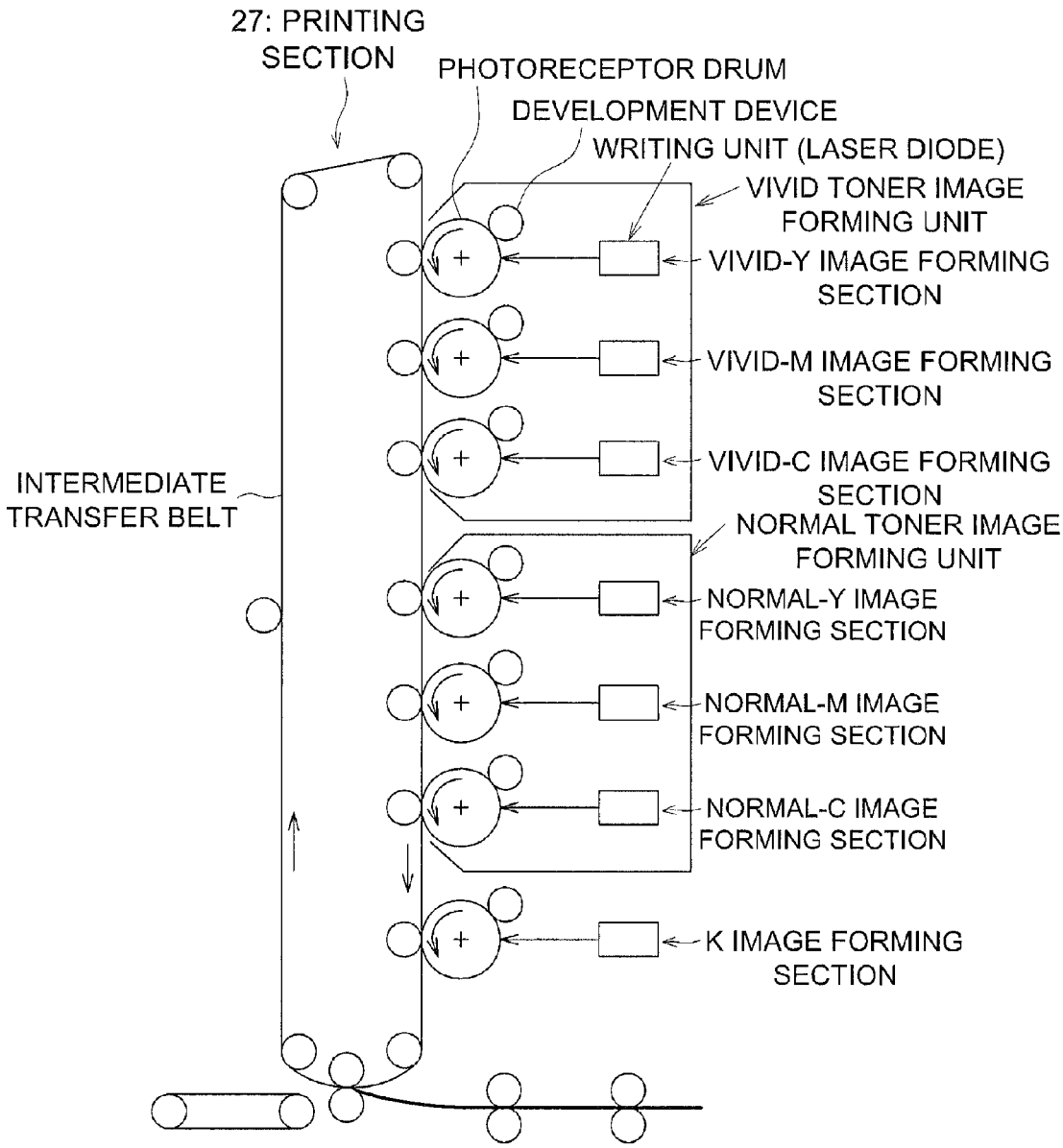
FIG. 6 is a view showing a constitution of an image forming apparatus according to an embodiment of the present invention, in which each printing section for each toner group is independently made as a unit.

In view of such problems, for example, as shown in FIG. 6 illustrating a main portion of printing section 27, image forming sections (writing units and photoreceptor units) of normal CMY toners are formed into a normal toner image forming unit and image forming sections (writing units and photoreceptor units) of Vivid CMY toners are formed into a Vivid toner image forming unit. Then, each of the image forming units is connected to a member (any specific configuration is employed) to mechanically move the image forming unit, and thereby can be brought into contact with or withdrawn from the intermediate transfer belt independently, under controlling of the print control section (print control program). Further, each image forming unit is allowed to be electrically controllable so as to be independently driven/stopped under controlling of the print control section (print control program).

Figure 7:
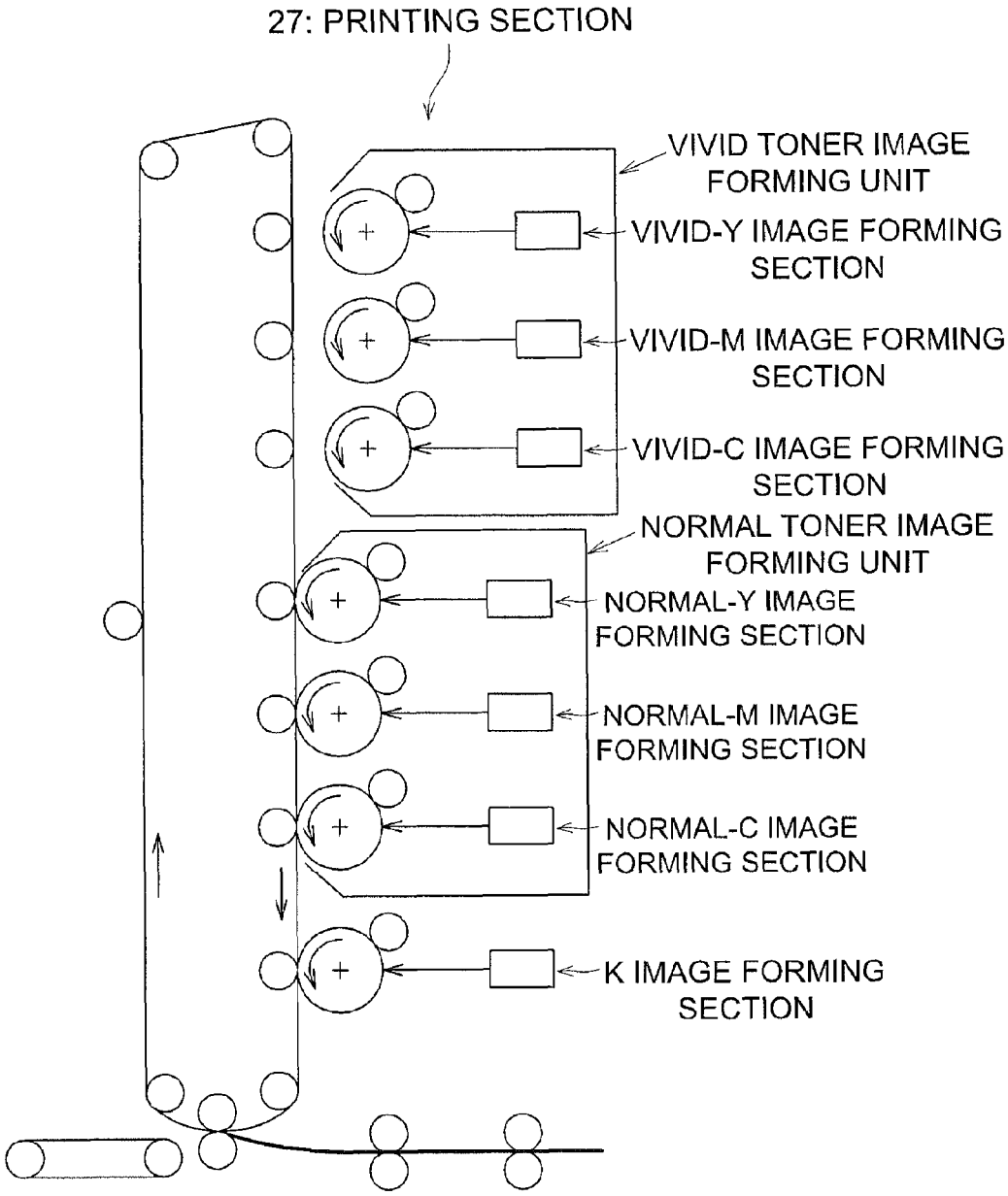
FIG. 7 is a view showing a state in which a Vivid toner image forming unit of a printing section of an image forming apparatus according to an embodiment of the present invention is withdrawn.

For example, in the case of print data having only a color area able to be printed without Vivid toners, as shown in FIG. 7, the Vivid toner image forming unit is withdrawn or suspended, whereby the consumption of unused Vivid toners can be minimized and also attaching of Vivid toner can be controlled. In contrast, in the case of print data having only a color area able to be printed without normal toners, as shown in FIG. 8, the normal toner image forming unit is withdrawn or suspended, whereby the consumption of unused normal toners can be minimized and also attaching of normal toner can be controlled.

In this case, the K (black) toner of the K (black)image forming section is commonly used for the normal toner and the Vivid toner, and therefore, the section is configured to be always in contact. Further, in cases in which the normal toner and the Vivid toner image forming sections are each unitized, when one image forming unit remains suspended over a long time, there is produced such a problem that toners may aggregate. Therefore, it is preferable to carry out controlling in such a way that an unused image forming unit is periodically driven or both image forming units are driven for a certain period of time on the occasion of power-on.

Further, in the case of a multi-color printer, an image is generally formed temporarily on an intermediate transfer belt using all the color toners, and then transferred to a sheet of printing paper. Therefore, for example, as shown in FIG. 9 illustrating a main portion of printing section 27, a single photoreceptor drum is allocated to a set of a normal and vivid toner of each of C, M, and Y colors, and the single photoreceptor drum is provided with development devices of a normal and Vivid toners and a writing unit. Thereby, via controlling of the print control section (print control program), the development devices and the writing units each can also independently be driven/stopped. This configuration makes it possible to reduce the number of photoreceptor drums, resulting in cost reduction. Further, since the size of printing section 27 is reduced, a smaller sized image forming apparatus 20 can be realized.

Herein, FIG. 5-FIG. 9 show the case in which seven colors in total including three colors of normal CMY toners, three colors of Vivid CMY toners, and K are used. However, normal CMYK toners and Vivid CMYK toners may be employed.

Next, characteristics of normal toners and Vivid toners used in the present embodiment will be described. FIG. 10 shows that in a representation method commonly referred to as Gamut (a color area able to be reproduced by peripherals such as a printer or a monitor), the color reproduction areas of a normal toner and a Vivid toner are represented. And the figure shows a three-dimensional color space, viewed from above, represented by Lab values (L-axis=brightness, a-axis=green to red, and b-axis=blue to yellow).

FIG. 10 shows that with regard to Blue, Magenta, Red, and Green, the color reproduction area (the solid line area in the figure) of the Vivid toners is wider than the color reproduction area (the dashed line area in the figure) of the normal toners. Further, with regard to Cyan, it is shown that the color reproduction area of the normal toners is wider than the color reproduction area of the Vivid toners. Still further, the thinly dotted area represents a color area able to be reproduced with either of both the normal toners and the Vivid toners. The densely dotted areas represent color areas able to be reproduced only with the Vivid toner. The area with oblique lines represents a color area able to be reproduced only with the normal toners.

Herein, plural types of toner groups in the present embodiment have only to satisfy the condition that their respective color reproduction areas are overlapped in some portion, and the color reproduction area of each toner group is not specifically limited. For example, in the case of FIG. 10, each group has a region that the other group could not reproduce. However, such a combination may be employed that the color reproduction area of one toner group includes the color reproduction area of the other toner group. Further, in the present embodiment, a color space represented by Lab is employed. However, employable is any appropriate color space represented by Device Independent Color such as CIE XYZ, which is independent of apparatuses.

Procedures for printing using the printing system of the above configuration will now be described.

Initially, user operation in computer terminal 10 of the present embodiment will now be described with reference to the flowchart of FIG. 13 and the screen examples of FIG. 11 and FIG. 12.

<User Operation>

Control section 11 of computer terminal 10 executes an application program. The user creates, using the application program, document data including predetermined color (Step S101).

Subsequently, printing is instructed by the file menu of the application program (Step S102), and then control section 11 controls the printer driver to display a printer driver screen 40 on display section 12 as shown in FIG. 11. Printer driver screen 40 is provided with fields to set a printer, a print range, the number of print copies, a print object, a print designation, and enlargement/reduction. The user operates operation section 13 to set each of the items. Then, when the property button in the printer designation field is depressed, control section 11 displays a property screen 41 on display section 11 as shown in FIG. 12.

Property screen 41 is provided with a field to set conditions of usage of Vivid toners. The user operates operation section 13 to set a Vivid level if required (Step S103), For example, when Vivid is intended to be emphasized, the Vivid level is set in the plus direction, whereby more image areas (bits) are printed with the Vivid toner. Alternatively, when cost reduction is desired by minimizing Vividness, the Vivid level should be set in the minus direction, whereby image areas (bits) printed with the Vivid toner is decreased. Still further, when cost is meant to be emphasized, "No Vivid toner used" should be selected, whereby printing is carried out only with a normal toner using no Vivid toners.

Further, property screen 41 is provided with a field to specify how to deal with a color outside the color reproduction area. The user operates operation section 13 to select an out-of-reproducible gamut processing (Step S104). For example, when a color area unable to be reproduced with any of normal toners and Vivid toners is contained, one option should be set from the followings: using the Vivid toners (Vivid output) for that color; and using the normal toners (normal output) for that color.

Still further, property screen 41 is provided with a field to set detailed items for printing. The user operates operation section 13 to select, for example, a document size, an output size, a printing types (single-side, double-side, and booklet), and finishing (stapling and punching) (Step S105).

After finishing the above-described setting of the Vivid level, selection of the out-of-reproducible gamut processing, setting of detailed items, the user presses an OK button on property screen 41 (Step S106).

Subsequently, processing of the printer driver in computer terminal 10 of the present embodiment will be described with reference to the flowchart of FIG. 14.

<Printer Driver Processing>

Initially, the printer driver interprets various parameters set on property screen 41 and converts these parameters into pieces of set information able to be described as a print job (Step S201).

Subsequently, the printer driver monitors whether or not the OK button has been depressed on printer driver screen 40 (Step S202).

When the OK button was depressed, the printer driver converts various kinds of converted set information and document data prepared by the application program into a print job of PDL to transmit this print job to image forming apparatus 20 (Step S203). In this case, gamut information is contained in the print job transmitted to image forming apparatus 20.

Next, the operation of image forming apparatus 20 of the present embodiment will be described with reference to the flowcharts of FIG. 15-FIG. 17. It should be noted that in memory 21*b* or HDD 21*c* of image forming apparatus 20, data to specify the color reproduction areas of a first toner group (in this case, normal toners) and a second toner group (in this case, Vivid toners) in a predetermined color space and an ICC profile (a device profile in which color characteristics of each device are described) are previously memorized.

Control section 21 of image forming apparatus 20 receives the print job transmitted from the printer driver (Step S301). When this reception is completed (Yes in S302), data for each page of the print job is rasterized to carry out conversion to a data format able to be printed by printing section 27, for example, image data of a bitmap format (Step 5303). Then, the converted image data is stored in memory 21*b* or HDD 21*c* (Step S304).

Subsequently, the control section (print control program) converts the stored image data into Lab data bit by bit (in other words, color information on each pixel of an image based on the image data is converted into a Lab value) using the ICC profile (Step S305). To be specific, as shown in FIG. 16, image data such as RGB or CMYK is input (Step S305*a*), and then, Device Dependent Color such as RGB or CMYK depending on the apparatus is color-converted into Device Independent Color such as Lab using the ICC profile (Step S305*b*) to output Lab data (Step S305*c*).

Subsequently, the control section (print control program) converts the image data into print data in the case of use of each toner group bit by bit using the ICC profile (Step S306). To be specific, as shown in FIG. 17, image data such as RGB or CMYK is input (Step S306*a*), followed by a specified image processing (Step S306*b*). Thereafter, using the ICC profile, color conversion processing is carried out (Step S306*c*) to output print data such as C'M'Y'K' (Step S306*d*).

Subsequently, the control section (print control program) reads data specifying the color reproduction area of each of the normal toners and the Vivid toners from memory 21*b* or HDD 21*c* to compare the value of the Lab data (Lab value) to the color reproduction areas of the normal toner and the Vivid toner (Step S307).

Then, the control section (print control program) judges whether or not the Lab value falls within the color reproduction area of the normal toners (Step S308). In the case of the Lab value being in the color reproduction area of the normal toners (in FIG. 10, the thinly dotted area and the area with oblique lines), the bit of the image data is classified into an area using the normal toner (Step S309).

Subsequently, the control section (print control program) judges whether or not the Lab value falls within the color reproduction area of the Vivid toners (Step S310). When the Lab value falls outside the color reproduction area of the normal toners and within the color reproduction area of the Vivid toners (in FIG. 10, the densely dotted area), the bit of the image data is classified into an area using the Vivid toners (Step S311).

Subsequently, the control section (print control program) reads the setting of an out-of-reproducible gamut processing previously set on property screen 41 of FIG. 12 from the print job. When the normal output is set (Yes in S312), the bit of the image data is classified into an area using the normal toner (Step S313). When the Vivid output is set (No in S312), the Bit of the image data is classified into an area using the Vivid toner (Step S314).

Subsequently, the control section (print control Program) judges whether or not processing for the entire bits of the image data has been processed (Step S315). When this processing was not finished, the same processing is repeated after returning to Step S305. The bit data each classified into the areas using the normal toner and the Vivid toner has a CMYK value of the normal toners and a CMYK value of the Vivid toners, respectively. The toner amount of the normal toners of CMYK and the toner amount of the Vivid toners of CMY are then set for the entire bits.

Subsequently, the control section (print control program) analyzes various kinds of parameters specified by the print job, followed by being sent, on the basis of the set values, to printing section 27 as print data for an photoreceptor drum of each color (Step Step S316).

Thereafter, printing processing is executed in printing section 27 (Step Step S317). In that process, in printing section 27 for any configuration of FIG. 5-FIG. 9, the control section (print control program) caries out such a control operation that when only one toner group is used, the operation of the image forming section (in the case of FIG. 9, the development devices and the writing units) corresponding to the unused toner group is suspended. Further, in printing section 27 for the configuration of FIG. 6, the control section (print control program) carries out such a control operation that when the normal toners are used, as shown in FIG. 7, the Vivid toner image forming unit is withdrawn; and when the Vivid toners are used, as shown in FIG. 8, the normal toner image forming unit is withdrawn.

Herein, in the above flow, it is assumed that the Vivid level was set to be 0 in the Vivid setting field of property screen 41 in FIG. 12. Thus, when the Lab value fell within the color reproduction area of the normal toner, the bit is classified in the area using the normal toners with no attention to where the bit is in the color reproduction area of a Vivid toner; and when the Lab value is outside the color reproduction area of the normal toner and within the color reproduction area of the Vivid toner, the bit is classified in the area using the Vivid toner. However, when the Vivid level is plus or minus, then the judgment criterion is different.

For example, when the relationship: Vivid level+1=10% is previously set, the value of the weighted Lab value (herein, 10% addition) is the judgment criterion, which means that the area 10% wider than the standard state is judged to be included in the area where the Vivid toners are used. Of course, the value of 10% may be set to be any value, and only a numerical value without the unit "%" may be increased or decreased.

Further, the border line between the color reproduction area of the normal toners and the color reproduction area of the Vivid toners is basically set on the border line between the color reproduction areas of the normal toners and the Vivid toners, however the border line may be shifted inside the color reproduction area of the normal toners or the color reproduction area of the Vivid toners. Thus, an image reflecting the user preference can be reproduced, for example an image with reduced cost or an image with the much Vivid toners used. In this case, the shifting amount can be set as desired, and a mode with no use of a Vivid toner may be set.

Still further, in the above flow, classification to the normal toner area or the Vivid toner area is performed bit by bit. However, it can be thought that an area unable to be reproduced with the normal toners has a certain size. Therefore, classification to the normal toner area or the Vivid toner area may be made in terms of area having plural bits (in other words, in terms of area of plural pixels). In this case, the average value of Lab values is determined in predetermined area, or the average value of RGB values of predetermined area is converted into a Lab value.

As described above, printing section 27 of image forming apparatus 20 is loaded with the first toner group (normal toners) and the second toner group (Vivid toners) with higher color saturation (a wider color reproduction area) than the first toner group. Therefore, image forming apparatus 20 does not need to be selected depending on the print object, and user convenience can be improved.

Still further, in cases of printing using only one toner group, the operation of the image forming section of the other toner group is suspended, or the image forming sections of the normal toners and the Vivid toners are unitized and then the image forming unit of the other toner group is withdrawn, whereby unnecessary consumption of unused toners is controlled, resulting in an extended product life cycle, and attaching of the toner remaining on the photoreceptor drum is controlled, resulting in enhanced print image quality. Further, by making an individual unit for two toners of each of C, M, and Y colors, the number of photoreceptor drums is reduced, resulting in realization of size reduction of an apparatus.

Yet further, image data of a print object is converted into a Lab value in terms of a predetermined unit, and which toner group to be used is determined depending on which color reproduction area of the groups of toner that Lab value belongs. Therefore, when reproduction can be made with either of the toner groups, the less expensive toner group can be used; and only when reproduction can be made only with more expensive toner group, that toner group can be used, resulting in minimal printing cost and enhanced color reproducibility.

It should be noted that in the above embodiment, description was made on the case of using two types of toner groups including normal toners and Vivid toners. However, the present invention is not limited thereto, and can be similarly applied to the cases in which at least three types of toner groups of different color reproduction areas are utilized.

A major advantage of the embodiment of the present invention is that printing can be performed using appropriate toners without selecting an apparatus to be used from apparatuses loaded with different toner groups.

That is because a first toner group such as normal toners and a second toner group such as Vivid toners with higher color saturation (a wider color reproduction area) than the first toner group are both loaded on one image forming apparatus, whereby two types of toner groups are selectively used on one apparatus. Further, another reason is that such control operations are carried out that the digitized data of the color of an image of a print object is compared with the color reproduction area of each toner group and when such color can be reproduced with only one toner group, that toner group is used; alternatively, when the color can be reproduced with either of the both toner groups, the first toner group is used; and when the color cannot be reproduced with any of the both toner groups, the second toner group is used.

Further, another advantage of the embodiment of the present invention is that the product life cycle of each loaded toner group can be extended while the decrease of print image quality resulting from an unused toner group can be decreased.

The reason is that when one toner group is used for printing, the operation of the image forming section of the other toner group is stopped, or the operation of an image forming unit formed via unitization of the writing unit and the photoreceptor unit of the other toner group is stopped or withdrawn from the transfer belt, whereby consumption of the other toner group can be minimized and the attaching of the toner remaining on the photoreceptor drum of the other toner group to a transfer belt can be controlled.

Another advantage of the embodiment of the present invention is that the size of an apparatus loaded with plural types of toner groups is reduced.

That is because one photoreceptor drum is employed for two toners of each of C, M, and Y colors, a development section for both of a first toner group and a development section and a writing unit, whereby the number of photoreceptor drums is reduced.

The present invention can be used for an image forming apparatus loaded with plural types of toner groups having different color reproduction areas and for a method and program for print control employing the image forming apparatus.

What is claimed is:

1. An image forming apparatus for forming a toner image of an image-formation object image, the apparatus comprising:

an image forming section, the image forming section including:

a photoreceptor drum;

a writing unit for forming an electrostatic latent image on the photoreceptor drum; and a development device configured to supply toner to the photoreceptor drum to develop the electrostatic latent image into the toner image, wherein the image forming apparatus is configured to be loaded, as the toner, with the following toner:

first cyan toner, first magenta toner, and first yellow toner which constitute a first toner group;

second cyan toner, second magenta toner, and second yellow toner which constitute a second toner group which has a wider color reproduction area than the first toner group; and black toner; and a control section configured to convert data of respective image portions constituting the image-formation object image into values in a predetermined color space, and select only one of the first toner group and the second toner group to use to form the toner image of the image-formation object image, depending on the values converted in the predetermined color space.

2. The image forming apparatus of claim 1, comprising:

seven of the image forming sections, each of which deals with each of the first cyan toner, the first magenta toner, the first yellow toner, the second cyan toner, the second magenta toner, the second yellow toner, and the black toner.

3. The image forming apparatus of claim 2, wherein three of the image forming sections, which deal with the first toner group, constitute a first image forming unit which is movable with respect to a transfer belt, to which the toner images are to be transferred from the first image forming unit;

three of the image forming sections, which deal with the second toner group, constitute a second image forming unit which is movable with respect to the transfer belt, to which the toner images are to be transferred from the second image forming unit; and when one of the imaging units forms toner images and transfers the formed toner image to the transfer belt, the other imaging unit withdraws from the transfer belt.

4. The image forming apparatus of claim 1, comprising:

four of the photoreceptors;

seven of the development device; and seven of the writing unit, wherein a first of the development devices to deal with the first cyan toner, a first of the writing units, a second of the development devices to deal with the second cyan toner, and a second of the writing units are arranged in conjunction with a first of the photoreceptor drums to constitute a first of the image forming unit;

a third of the development devices to deal with the first magenta toner, a third of the writing units, a fourth of the development devices to deal with the second magenta toner, and a fourth of the writing units are arranged to a second of the photoreceptor drums to constitute a second of the image forming unit;

a fifth of the development devices to deal with the first yellow toner, a fifth of the writing units, a sixth of the development devices to deal with the second yellow toner, and a sixth of the writing units are arranged in conjunction with a third of the photoreceptor drums to constitute a third of the image forming unit; and a seventh of the development devices to deal with the black toner and a seventh of the writing units are arranged in conjunction with a fourth of the photoreceptor drums to constitute a fourth of the image forming unit.

5. The image forming apparatus of claim 1, comprising:

a storage section for storing a first color reproduction area of the first toner group and the second toner group, wherein the control section is configured to select the only one of the first toner group and the second toner group, depending on the relationship between the values converted in the predetermined color space and the stored first color reproduction area and the second color reproduction area.

6. A method for control of printing in a system including an image forming apparatus which includes an image forming section having: a photoreceptor drum; a writing unit for forming an electrostatic image of the photoreceptor drum; and a development device for supplying toner to the photoreceptor drum to develop the electrostatic latent image into a toner image, wherein the image forming apparatus is loaded, as the toner, with a first toner group containing a first cyan toner, a first magenta toner, and a first yellow toner, and with a second toner group containing a second cyan toner, a second magenta toner, and a second yellow toner, wherein the second toner group has a wider color reproduction area than the first toner group, the method comprising the steps of:

(1) storing the color reproduction area, in a predetermined color space, of the first toner group and the color reproduction area, in the predetermined color space, of the second toner group;

(2) converting color information of image portions constituting a print object image into values in the predetermined color space;

(3) selecting only one of the toner groups to use to print the print object image, depending on a result of comparing the converted values with the stored two color reproduction areas; and (4) printing the print object image by using the selected toner group.

7. The method of claim 6, wherein the image forming apparatus includes seven of the image forming sections each of which deals with each toner of the first toner group, the second toner group, and black toner, and when printing in step (4), suspending operation of the image forming sections of the toner group which is not selected.

8. The method of claim 7, wherein the three image forming sections, each of which deals with each of the first cyan toner, the first magenta toner, and the first yellow toner, constitute a first movable image forming unit; and the three image forming sections, each of which deals with each of the second cyan toner, the second magenta toner, and the second yellow toner, constitute a second movable image forming unit, wherein when printing in the step (4), withdrawing the image forming unit of the suspended image forming sections from a transfer belt to which the toner images formed on the photoreceptor drums are transferred.

9. The method of claim 6, wherein the image forming apparatus includes four of the photoreceptors, seven of the development device, and seven of the writing unit, wherein a first of the development devices to deal with the first cyan toner, a first of the writing units, a second of the development devices to deal with the second cyan toner, and a second of the writing units are arranged in conjunction with a first of the photoreceptor drums;

a third of the development devices to deal with the first magenta toner, a third of the writing units, a fourth of the development devices to deal with the second magenta toner, and a fourth of the writing units are arranged in conjunction with a second of the photoreceptor drums;

a fifth of the development devices to deal with the first yellow toner, a fifth of the writing units, a sixth of the development devices to deal with the second yellow toner, and a sixth of the writing units are arranged in conjunction with a third of the photoreceptor drums; and a seventh of the development devices to deal with the black toner and a seventh of the writing units are arranged in conjunction with a seventh of the photoreceptor drums, wherein when printing in the step (4), suspending operation of the development devices and the writing units of the toner group which is not selected.

10. An image forming apparatus, comprising:

an image forming section for forming a color image by superposing a cyan toner image, a magenta toner image, a yellow toner image, and a black toner image, the image forming section including:

a first development device group configured of three development devices each of which supplies each of a first cyan toner, a first magenta toner, and a first yellow toner to develop an electrostatic latent image into a toner image;

a second development device group configured of three development devices each of which supplies each of a second cyan toner, a second magenta toner, and a second yellow toner to develop an electrostatic latent image into a toner image, the second toners having a wider color reproduction area than the first toners;

a black development device for supplying black toner to develop an electrostatic latent image into a toner image; and a control section configured to convert data of respective image portions constituting an image-formation object image into values in a predetermined color space, and select only one of the first development device group and the second development device group to use to form an image of the image-formation object image, depending on the values converted in the predetermined color space.

11. The image forming apparatus of claim 10, wherein the image forming section includes:

a first cyan image generating section configured to contain the development device, of the first development device group, which deals with the first cyan toner;

a first magenta image generating section configured to contain the development device, of the first development device group, which deals with the first magenta toner;

a first yellow image generating section configured to contain the development device, of the first development device group, which deals with the first yellow toner;

a second cyan image generating section configured to contain the development device, of the second development device group, which deals with the second cyan toner;

a second magenta image generating section configured to contain the development device, of the second development device group, which deals with the second magenta toner;

a second yellow image generating section configured to contain the development device, of the second development device group, which deals with the second yellow toner; and a black image generating section configured to contain the black development device.

12. The image forming apparatus of claim 11, wherein the first cyan image generating section, the first magenta image generating section, and the first yellow image generating section constitute a first movable image forming unit; and the second cyan image generating section, the second magenta image generating section, and the second yellow image generating section constitute a second movable image forming unit.

13. The image forming apparatus of claim 10, wherein the first image forming section, the development device of the first development device group, which deals with a first cyan toner and the development device of the second development device group, which deals with a second cyan toner constitute a cyan image generating section;

the development device of the first development device group, which deals with a first magenta toner and the development device of the second development device group, which deals with a second magenta toner constitute a magenta image generating section;

the development device of the first development device group, which deals with a first yellow toner and the development device of the second development device group, which deals with a second yellow toner constitute a yellow image generating section; and the black development device constitutes a black image generating section.

14. The image forming apparatus of claim 10, comprising:

a storage section for storing a first color reproduction area, in the predetermined color space, of the toners of the first development device group and a second color reproduction area, in the predetermined color space, of the toners of the second development device group, wherein the control section is configured to select the only one of the first development device group and the second development device group, depending on a relationship between the values converted in the predetermined color space and the stored first color reproduction area and the second color reproduction area.

* * * * *